US012096830B2

(12) United States Patent
Lipman

(10) Patent No.: US 12,096,830 B2
(45) Date of Patent: Sep. 24, 2024

(54) ERGONOMIC CANE WITH NOVEL BASE AND ADDITIONAL COMPONENTS

(71) Applicant: Roberta A. Lipman, Bronx, NY (US)

(72) Inventor: Roberta A. Lipman, Bronx, NY (US)

( * ) Notice: Subject to any disclaimer, the term of this patent is extended or adjusted under 35 U.S.C. 154(b) by 0 days.

(21) Appl. No.: 18/446,644

(22) Filed: Aug. 9, 2023

(65) Prior Publication Data

US 2024/0016268 A1 Jan. 18, 2024

Related U.S. Application Data

(62) Division of application No. 17/541,064, filed on Dec. 2, 2021, now Pat. No. 11,758,992.

(51) Int. Cl.

| | |
|---|---|
| ***A45B 9/04*** | (2006.01) |
| ***A45B 3/04*** | (2006.01) |
| ***A45B 9/02*** | (2006.01) |
| *A45B 9/00* | (2006.01) |

(52) U.S. Cl.
CPC ..... *A45B 9/04* (2013.01); *A45B 3/04* (2013.01); *A45B 9/02* (2013.01); *A45B 2009/007* (2013.01)

(58) Field of Classification Search
CPC ..... A45B 9/04; A45B 2009/005; A45B 9/00; A45B 2200/00; A45B 2200/05; A45B 2200/055; A61H 3/0288
See application file for complete search history.

(56) References Cited

U.S. PATENT DOCUMENTS

| | | | | |
|---|---|---|---|---|
| 4,858,125 | A | 8/1989 | Washizuka et al. | |
| 5,167,746 | A | 12/1992 | Sheenan | |
| D512,558 | S | 12/2005 | Martinez | |
| 7,686,025 | B1 | 3/2010 | Dowling | |
| D652,616 | S | 1/2012 | Browne, Jr. | |
| 8,844,548 | B2 | 9/2014 | Soletski et al. | |
| 10,098,424 | B1 | 10/2018 | Husted et al. | |
| 10,206,467 | B1 | 2/2019 | Swerdlow | |
| D889,110 | S | 7/2020 | Benjamin | |
| D890,509 | S | 7/2020 | Benjamin | |
| D891,080 | S | 7/2020 | Benjamin | |
| D892,488 | S | 8/2020 | Benjamin | |
| 11,109,654 | B2 | 9/2021 | Winn | |
| 2005/0016572 | A1* | 1/2005 | Townsend | A61F 2/76 135/82 |
| 2007/0106397 | A1* | 5/2007 | Townsend | A61H 3/0288 623/52 |
| 2007/0277863 | A1 | 12/2007 | Gordon | |
| 2009/0056778 | A1 | 3/2009 | Dean | |

(Continued)

FOREIGN PATENT DOCUMENTS

| | | | | |
|---|---|---|---|---|
| FR | 2990600 | A1 * | 11/2013 | A45B 9/00 |

OTHER PUBLICATIONS

Restriction Requirement issued in U.S. Appl. No. 17/541,064 on Sep. 27, 2022.

(Continued)

*Primary Examiner* — Noah Chandler Hawk

(74) *Attorney, Agent, or Firm* — Hogan Lovells US LLP

(57) ABSTRACT

A system for a walking cane is provided. The walking cane may include a stem and a base, and the base may be provided in the shape of a human foot. The base may be made of various types of materials, such as a flexible silicone or rubber material. The foot shape may provide a natural, ergonomic feel for the user.

20 Claims, 16 Drawing Sheets

(56) References Cited

U.S. PATENT DOCUMENTS

| | | | | |
|---|---|---|---|---|
| 2010/0229903 | A1 | 9/2010 | Ozuna et al. | |
| 2010/0288319 | A1* | 11/2010 | Luo | A45B 9/00 135/65 |
| 2014/0332045 | A1 | 11/2014 | Rudin | |
| 2018/0243156 | A1 | 8/2018 | Tryba | |

OTHER PUBLICATIONS

Non-Final Office Action issued in U.S. Appl. No. 17/541,064 on Dec. 6, 2022.
Final Office Action issued in U.S. Appl. No. 17/541,064 on Mar. 9, 2023.
Notice of Allowance issued in U.S. Appl. No. 17/541,064 on May 31, 2023.

* cited by examiner

ERGONOMIC CANE WITH NOVEL BASE AND ADDITIONAL COMPONENTS

CROSS-REFERENCE TO RELATED APPLICATION

This application is a divisional application and claims priority to U.S. patent application Ser. No. 17/541,064, filed Dec. 2, 2021, of which is incorporated by reference herein in its entirety.

FIELD

This application generally relates to ergonomic walking canes, as may include a handle, stem, and flexible base.

BACKGROUND

Often, an individual using a walking cane may essentially walk on one foot when in motion (e.g., one foot may be elevated during propulsion while balancing their body-weight on the cane). In other instances, an individual may at least put a significant amount of weight on this walking cane versus one of the individual's legs. However, this uneven balance often creates a lack of stability and comfort for the user. Accordingly, there is a need for a cane that may provide a safe, stable design while also providing emotional satisfaction to a user.

SUMMARY

In general, various walking canes are described. In at least one embodiment, a walking cane can have a handle, a stem coupled to the handle, and a base coupled to the stem, where the base may be configured to be in a shape of, or approximating, a human foot. The base may be comprised of a plurality of portions, with one portion being flexible responsive to a force applied to one or more other portions. The handle may have an alarm button configured to cause one or more components of the walking cane to make a loud noise, send a notification to predetermined personnel, or provide a location of the walking cane, among other such options. A walking cane base may be made of a material such as rubber, cushioned rubber, or silicone, or any other polymers/combination of polymers that allow for the cane base to be flexible. Additionally, a cane stem may be adjustable, and may have a bending portion provided between a first segment of the stem and a second segment of the stem. Upon activation, the bending portion may move relative to a force exerted by the first segment and the second segment within a predetermined range. An example stem may have a lighting portion that can be activated by at least one of a detected motion of the walking cane and a lighting change of a surrounding environment. A walking cane base may have at least one adjustable portion configured to extend or retract the base to a plurality of sizes and/or shapes.

Also described are systems comprising a supporting member configured to be received by an arm of a user, and a base member coupled (directly or indirectly) to the supporting member, where the base member may be configured to be in a specific shape, such as a shape of, or approximating, a human foot. The supporting member may be a crutch or a hiking/walking cane, and the base member may be configured to be covered by a covering, such as a shoe or a boot. The base member may be made of a material such as silicone, and may be removable from the supporting member. The base may have one or more adjustable portions configured to extend or retract the base to a plurality of sizes and/or shapes.

BRIEF DESCRIPTION OF THE DRAWINGS

The multiple drawings refer to example embodiments of the design.

DETAILED DESCRIPTION

Figure 1B:
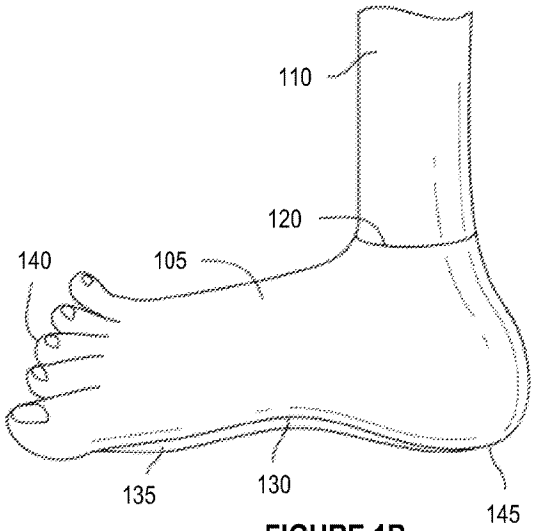
FIG. 1B is a detailed schematic diagram of an example base of a walking cane, in accordance with an embodiment.

In the following description, numerous specific details are set forth, such as examples of an ergonomic walking cane and associated features, in order to provide a thorough understanding of the present design. It will be apparent, however, to one skilled in the art that the present design may be practiced without these specific details. Thus, the specific details set forth are merely exemplary. The specific details discussed in one embodiment may be reasonably implemented in another embodiment. The specific details may be varied from and still be contemplated to be within the spirit and scope of the present design.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment," "an embodiment," "certain embodiments," or "other embodiments" of the present disclosure are not intended to be interpreted as excluding the existence of additional embodiments that also incorporate the recited features. Furthermore, reference to terms such as "above," "below," "upper," "lower," "side," "front," "back," or other terms regarding orientation or direction are made with reference to the illustrated embodiments and are not intended to be limiting or exclude other orientations or directions.

Globally, there has been a marked increase in the number of people needing some sort of walking aid, such as a walking cane, walker, wheelchair, or scooter. A majority of people in this group of people prefer using a walking cane due to its ease of use, stability and adaptability to changes in climate, and compactness for easy transport.

As explained above, a typical individual using a walking cane may naturally shift their weight back and forth between the cane and legs when in motion. However, this uneven balance creates a lack of stability and less comfort for a user. Thus, example embodiments provided herein seek to address at least this problem by providing a walking cane, or other such support member, that provides a greater sense of reliability and stability on a wider base.

For example, example embodiments described herein include a base attached to a cane, where the base may be selected or designed to be close to the size of a user's actual foot, and the cane as a whole can be designed, sized, or selected to closely mimic the way a human (e.g., the user) would naturally walk.

In at least one embodiment, such a walking cane can be suitable for anyone needing assistance with walking, but could benefit from a cane with better balance than existing cane implementations, that is lightweight, that is adaptable for multiple environments, and/or that is height-adjustable. For example, a cane as described herein can be suitable for those with knee and hip issues, the elderly, rehabilitation patients, military veterans, or those recovering from medical procedures, among other such options.

Additionally, a cane as described herein may be adapted for use by other animals, such as dogs, cats, elephants, cows, horses, etc. Such an embodiment may be useful for an animal that is rehabilitating one or more limbs, or for an animal that may rely on a prosthetic device to move efficiently.

An example cane in accordance with at least one embodiment is primarily made up of three parts: a handle, a stem, and a base. However, other embodiments may have additional, fewer, or alternative parts, and may have one or more ornaments or features added, as may include decorative pieces or shoes which fit around the base. The base in this example may be created using a cast and mold method, where a mold can be created based on a user's actual foot size. A stem can be coupled to or otherwise attached to the base, and a handle can be coupled to or otherwise attached to the stem, to assemble an entire cane. In at least one embodiment, assembly of such a cane may enable a user to quickly and efficiently disassemble the cane, for example to store the cane, and then reassemble the cane when needed. Moreover, the pieces of an example cane may include quick-connection features, such as threaded fasteners, clips, tongue and groove fasteners, press fittings, and the like to facilitate rapid assembly and disassembly while also reducing strain or stress of users performing such assembly and disassembly.

Further, according to another example, a stem of a cane may be collapsible such that the stem may fold into different portions (e.g., a first sub-portion, a second sub-portion, etc.). For example, the stem may fold in half, in thirds, or in quarters to that an overall length of the stem when collapsed is a length of one of the sub-portions. Such a configuration may allow the cane to fold compactly for ease of transport, for example.

According to another example, there may be a two-footed base meeting at one part of a walking cane stem. In an example, the two feet may have "legs" which meet at the stem, and these legs may be powered electronically, among other such options. According to another example, a pulley mechanism may be provided at a center point where legs or stems coupled to a base of a walking cane meet and may help control the legs or stems such that one leg or stem is always on the floor while the other leg or stem "walks."

Figure 1C:
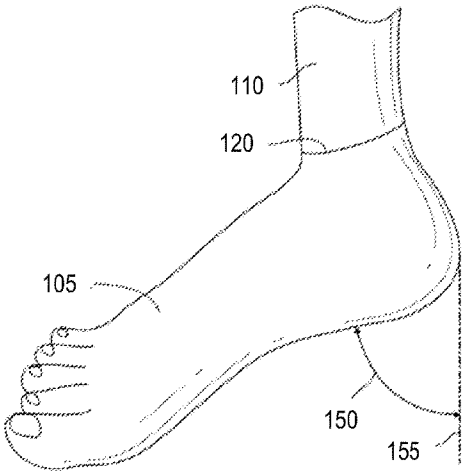
FIG. 1C is a detailed schematic diagram of an example flexible base of a walking cane, in accordance with an embodiment.
Figure 1A:
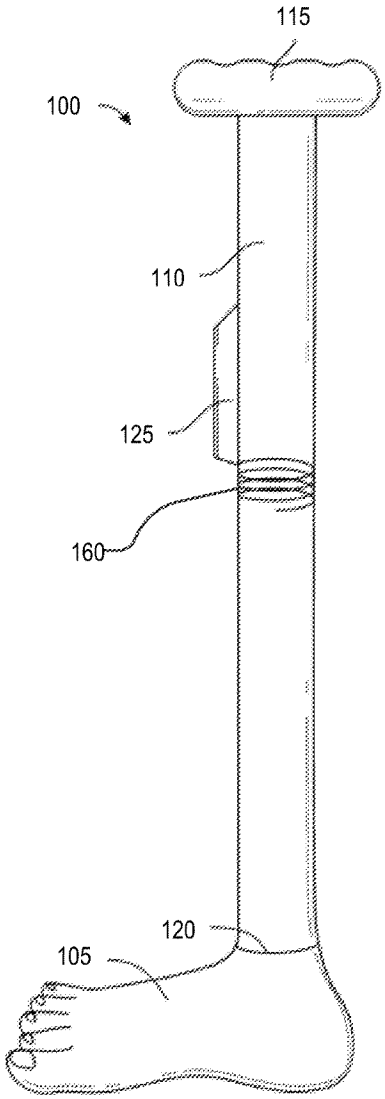
FIG. 1A is a schematic diagram of an example walking cane with a light-emitting attachment and a handle, in accordance with an embodiment.

FIGS. 1A to 1C are schematic diagrams of an example cane 100 and associated features of the cane 100, according to an example embodiment. Specifically, FIG. 1A shows a schematic diagram of an example cane 100 according to an example embodiment, where the cane 100 may have a base portion 105 connected to a stem portion 110. The stem portion 110 may be connected to a handle portion 115. At some location between the base portion 105 and the stem portion 110, there may be a connecting portion 120. This connecting portion 120 may connect the base portion 105 to the stem portion 110, and may be provided in the form of a pop-on cap, a screw-in portion, or some other connection such that the base portion 105 may be connected to or secured to the stem portion 110.

FIG. 1A also shows an optional lighting portion 125 which may be activated by a detected motion, activated by a manual input such as a button, switch, or voice input, and/or activated in response to a change in a surrounding environment. For example, if the surrounding environment is dark, an example lighting portion 125 may be automatically activated for ease of user navigation.

An example lighting portion may be provided elsewhere on a cane 100, such as by a base portion 105, other parts of a stem portion 110, or by a handle portion 115. In one or more embodiments, a lighting portion 125 may include a power supply to illuminate one or more bulbs. The power supply may be a rechargeable supply or a renewable supply, such as one or more solar panels. In at least one embodiment, a lighting portion 125 may include a replaceable battery source. In at least one embodiment, a lighting portion 125 may be clipped or secured to the cane 100 such that the lighting portion 125 may be movable to various locations based on one or more user preferences. By way of example only, a lighting portion 125 may include a strap or biasing member to wrap around one or more portions of cane 100 to secure the lighting portion 125 to a desired location.

At or near a lighting portion 125, a medical chip or GPS chip, described elsewhere herein, may be provided to contact emergency personnel with an accurate location in case of a medical emergency, for example. Alternatively, a medical chip or GPS chip may be provided on a handle portion 115, beneath a location where a hand of a user may be received. A hermetic pocket or other such enclosure may be provided for a chip to slide into for security.

According to an example embodiment, a stem portion 110 may include an internal telescoping mechanism 160 to lengthen or shorten a height of the stem portion 110, to accommodate heights of various users. The internal telescoping mechanism 160 may be twisted to lengthen or shorten a stem portion 110.

According to another example, a base or stem may have a magnetic portion or a clasping portion for picking up items from the floor. For example, a base of a cane may have a magnetic portion at a toe area or a heel area to attract magnetic items off the floor. A base or stem of the can may also have a claw-like mechanism or a clamp for gripping an item off the floor, to provide an additional utility to the user. This magnetic portion, claw-like mechanism, and/or clamp maybe removable.

While the present example illustrates a base portion 105 approximating a human foot on a right side of a body, base portion 105 may also approximate a human foot for a left side of the body, depending on the needs of the user. Because the base portion 105 is removable, a right-side base and a left-side base may also be interchangeable. Additionally, the base portion may also approximate a human foot such that the base portion is in a shape approximating a kidney bean, where one or more toe portions are connected to each other. According to such an example, the toe portions may be webbed or connected to the rest of the base portion as a uniform solid. Further, one or more toe portions may include an arch at the bottom, where the toe portions connect to the remainder of the base portion, to enable flexion when in use.

FIG. 1B shows a detailed schematic diagram of an example base portion 105, the stem portion 110, and the connecting portion 120, according to the example embodiment shown in FIG. 1A. As provided in FIG. 1B, the base portion 105 may be provided in a shape of, or approximating of a human foot, and the base portion 105 may have an arch portion 130, a ball portion 135, one or more toe portions 140, and a heel portion 145. These portions 130, 135, 140, and 145 may enable the base portion 105 to move in a manner that resembles a natural motion of a human foot. For example, the one or more toe portions 140 may flex or pivot about certain points, similar to joints. Additionally, in at least one embodiment, the arch portion 130 may be constructed of a material that allows flexion, and may be of a different material than other areas of the base portion 105. This flexion may simulate the flexing of an arch of the foot. Further, according to at least one embodiment, a base portion may be provided such that an assembly including a stem portion or crutch portion can stand upright alone without the need to physically hold the stem portion or crutch portion upright. A structure of a base portion may enable the assembly to stand upright, where the base portion provides support to the assembly.

A base portion such as base portion 105 may be provided in a variety of colors, including colors which may closely match or approximate a skin color of a user. Other colors may be provided, or decorations may be printed on the base portion such as a tattoo or other such decoration.

FIG. 1C shows a detailed schematic diagram of the base portion 105, part of the stem portion 110, and the connecting portion 120, according to the example embodiment shown in FIG. 1A, but the base portion 105 is provided at a downward angle 150 relative to an axis 155. This angle 150 may resemble a human foot that points downward when it is in the motion of completing a physical step. The flexibility provided by the arch and the flexibility provided by the connection to the stem at connecting portion 120 may allow for the base portion 105 to move in a natural motion that resembles a human foot. According to an example, when a base portion 105 is lifting off the ground in preparation for a second step, the toes may bend slightly and the arch may lift upward while the base portion 105 at the connecting portion 120 bends downward. Base portion 105 may be rocked from "heel" to "toe" via an arch, such as arch 130 in FIG. 1B. A bottom portion of the base portion 105 may be cushioned and provided with a softer material than the rest of base portion 105.

According to an example embodiment, connecting portion 120 may be provided such that a base portion 105 may be removable or detachable. For example, base portion 105 may be screwed into place with respect to a stem portion 110, such that base portion 105 may be connected to and secured to stem portion 110. In a case where base portion 105 is removed, a base plate may be attached to replace the base portion 105, such that the cane 100 may still be operable without causing substantial damage to a stem portion 110.

Alternatively, base portion 105 may be connected via welding, epoxy, or other such fixed connections. According to another example, a base portion 105 may be connected to a stem portion 110 via one or more adapters. For example, an adapter may be provided in the form of one or more clips which may snap at or above connecting portion 120, with a flange provided at a bottom of a base portion 105. The flange may apply an upward force on the base portion 105, to secure the base portion 105 to the stem portion 110. Multiple adapters may be utilized, such as one on either side of base portion 105, or one adapter on the side of a "heel" portion of the base portion 105, or some combination thereof.

According to yet another example, base portion 105 may be provided with a spring-loaded clip which may expand when inserted into a bottom of a stem portion 110. For example, the spring-loaded clip may be comprised of at least two prongs with a spring provided in between such that when the two prongs are pressed together, the spring compresses and the prongs and spring may be inserted into an opening at a bottom of the stem portion 110. When released, the spring may expand within the stem portion 110, and the two prongs may hold the base portion 105 in place. To remove, a user may apply a downward force on the top of base portion 105, or hold base portion 105 in place while pulling stem portion 110 upwards, to collapse the spring and remove the prongs from the stem portion 110.

According to another example, base portion 105 may be provided with a rubber seal which may wrap around a bottom of stem portion 110 to secure the base portion 105 to the stem portion 110. Alternatively, a rubber seal may be provided within base portion 105 with an opening for stem portion 110 to fit into.

Figure 2:
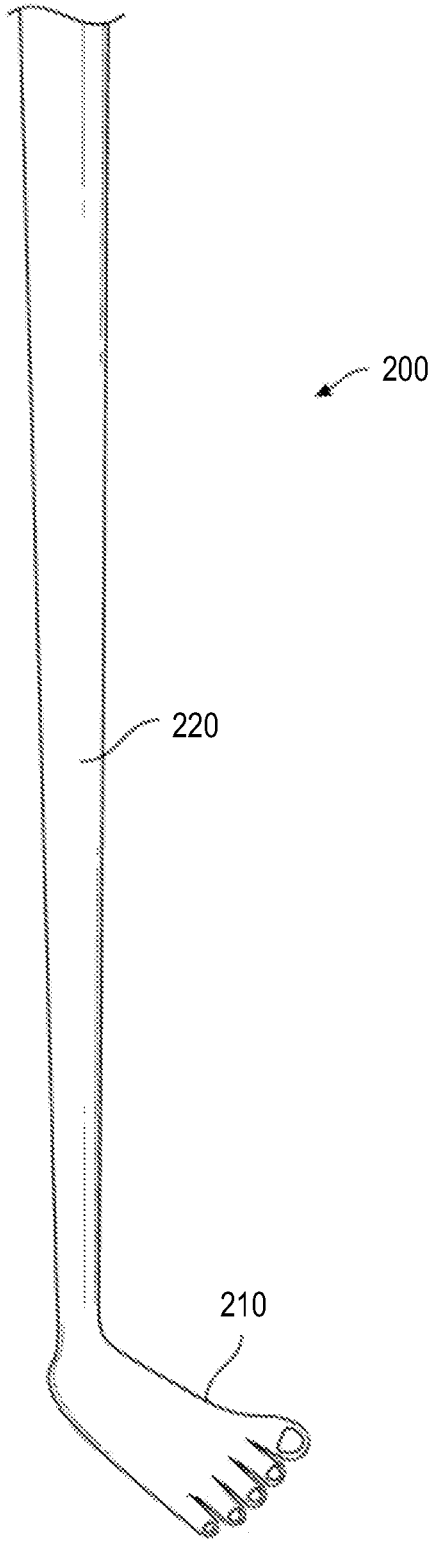
FIG. 2 is a perspective view of an example walking cane, in accordance with an embodiment.

FIG. 2 is a perspective view of an example walking cane 200 in accordance with at least one embodiment. In an embodiment, the walking cane 200 may have a base portion 210, which may be detachable from a stem portion 220.

According to an example embodiment, a base portion 210 of a walking cane 200 may have a bottom sole portion made of a material such as rubber or silicone, by way of example only, to provide stability and to prevent slippage. Additionally, the base portion 210 may be in a shape of, or approximating, a human foot for comfort of use. As will be described below, by providing the base portion 210 in a shape of, or approximating, a human foot, and in some embodiments similar in size and shape to a user's foot, a more natural walking gait may be achieved while also providing improved comfort and stability.

In an example embodiment where an animal may need prosthetic support or support of one or more limbs, a base portion may be provided in a shape of, or approximating, the animal's foot, paw, or other corresponding body part depending on the animal. A stem portion connected to the base portion may be provided with similar curves, bends, and dimensions to approximate a limb of the animal. Further, instead of a handle portion, an end of the support on an end of the stem opposite of the base may have a connection portion that may receive an appendage of the animal, or may be provided with a strap or other fastening means to secure the support to the animal. The base portion or a bottom of the base portion may be provided with one or more materials that most closely match one or more features at a bottom of the animal's natural foot or paw. Further, the base and stem may be provided of different materials, or may be hollowed out, as needed to fit size and weight requirements depending on the animal using the support.

In at least one embodiment, a base portion 210 may include one or more features associated with a foot, such as toes, a ball of the foot, an arch, a heel, and an ankle that move in a manner that in some ways mimics a human foot. For example, the toes may flex or pivot about certain points, similar to human joints, and may be made of a material that is softer than the rest of the base portion 210. Additionally, in at least one embodiment, an arch for the base portion 210 may be constructed of a material that allows flexion that may be different from other areas of the base portion 210, which may enable the flexing of an arch of the foot. Further, according to at least one embodiment, a heel portion for the base portion 210 may be dimensionally wider than an ankle portion. Such a configuration may provide for additional stability to the user.

As an example, an ankle portion may be at least three inches in circumference to support the base portion. The ankle portion may be provided with a flexible material such that it does not break when the base portion moves. Additionally or alternatively, the ankle portion may be provided with a hinge connector that may have another portion to bend the ankle portion back into place, or may be a ball and socket-type connector connecting the base portion to the ankle portion.

In one or more embodiments, base portion 210 may be formed from a combination of materials. As an example, the top of the base portion 210 can be made of any reasonable material while a bottom may be made from a material such as rubber, silicone, or other such material to reduce potential slipping or sliding during use. According to an example embodiment, the entire base portion 210 may be made of a material such as rubber, silicone, or other latex or latex-like material for shock absorption and comfort. Additionally, the material at the bottom of or comprising the entire base portion 210 may be made of a material that is not slippery on polished surfaces, wet or icy pavement, and other types of surfaces.

The base portion may have a more modern design, where the base portion is modeled on top of another base. For example, the base portion may be made of a different material such as aluminum, but a bottom of the base portion may be attached to a rubber base or sole to serve a similar purpose as a base made entirely of rubber or silicone. For example, a rubber base or sole may snap onto or otherwise be attached to a bottom of the base portion. Additionally, a sole may include one or more spikes or grips to accommodate usage on various terrains. Accordingly, embodiments of the present disclosure may be directed toward a cane that may include detachable or fixed components made from a variety of materials to facilitate operation in different conditions.

Figure 3:
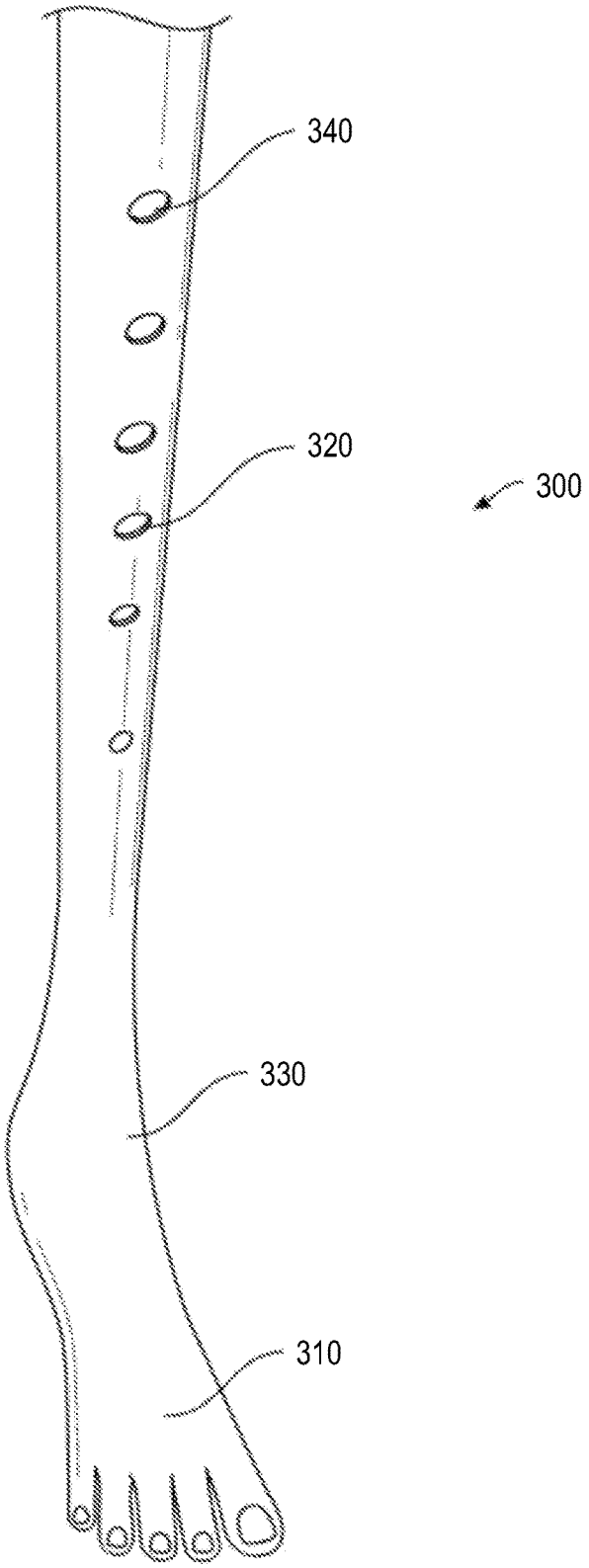
FIG. 3 is a detailed perspective view of an example walking cane, in accordance with an embodiment.

FIG. 3 is a detailed perspective view of a portion of an example walking cane 300 in accordance with at least one embodiment. It should be appreciated that cane 300 may share one or more features with cane 200. In this example, an example adjustable stem portion 320 may be attached to a base portion 310. Connecting portion 330 may be a press/interference fit and may be provided as an example means for connecting the stem portion 320 and the base portion 310. Connecting portion 330 may also be a screw-in portion or a pop-on portion.

The stem portion 320 of the cane may have an adjustable height that may be adjustable to a plurality of sizes to best fit the needs of a user. The height of the stem portion 320 may be adjusted through various means. For example, the height may be adjusted using notches 240 provided along the stem portion 320, as shown in FIG. 3. By way of example, a biased pin may be arranged on an internal sliding pole or structure that may be biased outward to extend through a notch 240 formed in an external pole to set a specific height. To adjust the height, a user may overcome the biased pin, for example by pressing on the pin, and then side the internal or external pole to move the pin to a different notch 340.

Alternatively, the height may be adjusted by twisting a portion of a stem up and down to lengthen or collapse two interlocking pieces. By way of example, a stem portion may be comprised of two main pieces, with one piece having a smaller diameter than the other. The piece with the smaller diameter may fit inside the piece having a larger diameter. Additionally, the piece having the larger diameter may have an adjusting means with a spring to receive the piece having the smaller diameter at adjustable intervals while the piece having the smaller diameter twists relative to the piece having the larger diameter.

A stem portion according to an example embodiment may be comprised of a durable and light-weight material such as bamboo, among other such options. A stem portion may alternatively be made of other materials, including various types of metals, wood, and plastics, or a combination of these materials, depending on a user's need, manufacturing capabilities, or other such requirements.

A stem portion may essentially be straight in shape, but a stem portion may alternatively be curved or include multiple bends to accommodate various needs of a user. As an example, a stem portion may be curved closer to a top of the stem portion towards the handle to provide relaxation to a user's hand. As another example, a stem portion may be curved at a bottom portion of the stem portion to ease tension on a user's body.

According to an example embodiment, a stem portion may have a light source placed on or coupled to the stem portion for use in various conditions such as in dark or dim environments. As an example, a light source may be activated in response to detecting motion of a cane, via one or more sensors of the cane. The light source may alternatively be activated in response to detecting motion of an object relative to the cane. The light source may additionally or alternatively be placed on a base of the cane. For example, the light source may be positioned at a top of the base near where the base connects to a stem portion, or one or more light sources may be placed at individual toes of a base. Additionally, according to another example, one or more light sources may be placed or positioned underneath a base and towards the sides of a base.

In an example embodiment, a sensor may be provided which may detect an object or obstacle near the cane. Such a sensor may include a camera, ultrasonic wave detector, or electromagnetic wave detector. The sensor may be coupled, wired or wirelessly, to a computing device which may determine what the object or obstacle is. In a case where the sensor detects the object or obstacle, a signal may be sent to a handle of the cane to cause a vibration. Other alerts may be provided, such as an audible noise or light indicating that an object or obstacle is nearby.

Figure 4:
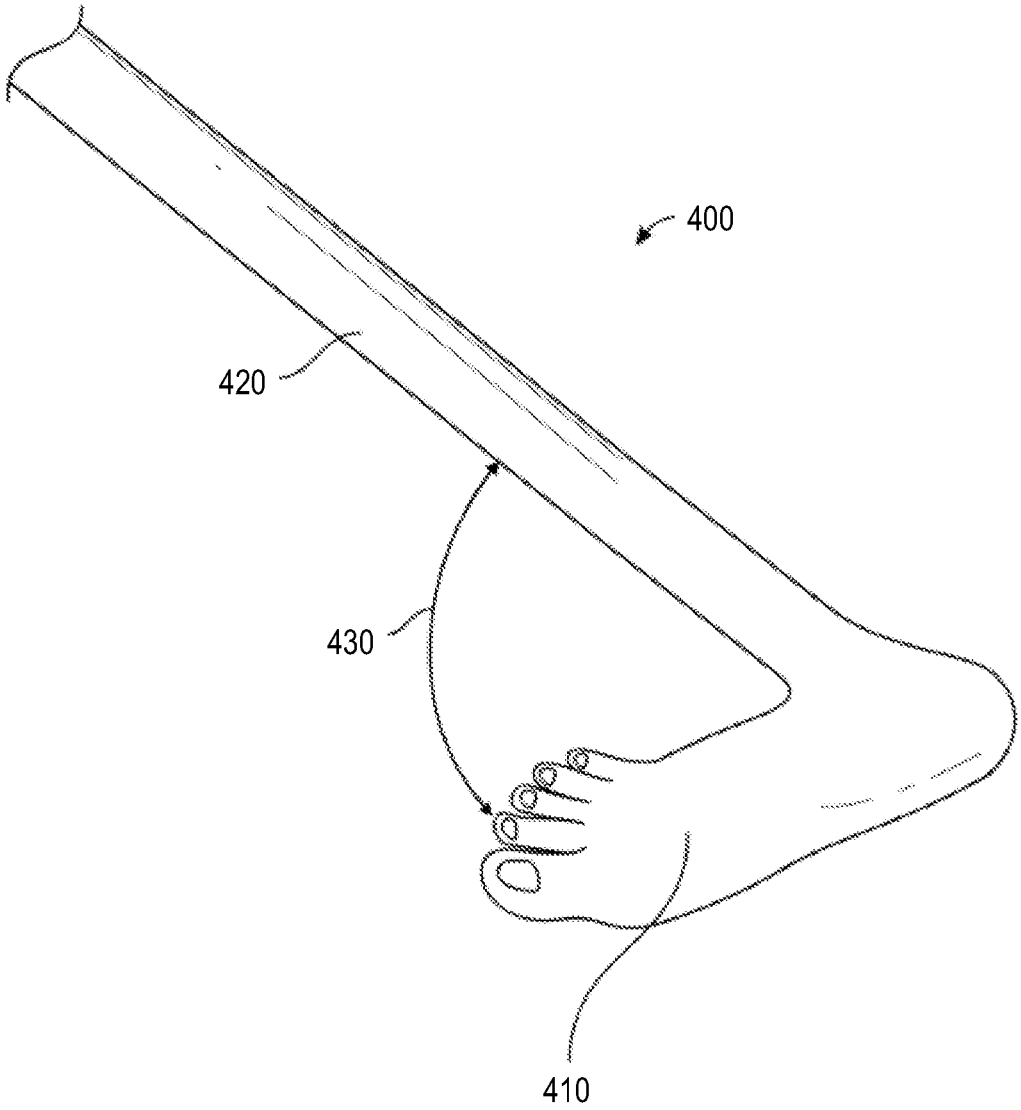
FIG. 4 is a perspective view of an example walking cane with a flexible base, in accordance with an embodiment.

FIG. 4 is a perspective view of an example walking cane 400 having a stem 420 provided at a forward angle 430, a base 410 leaning at an angle 430, the base 410 being acute to the stem 420, and a connecting portion 440 that may support a bend at the forward angle 430 between the base 410 and the stem 420, according to an example embodiment. This angle 430 is provided only as an example, and is not intended to be limiting. As mentioned elsewhere herein, a base 410 may be made of a material such as silicone or other such materials including polymer materials and rubber or cushioned rubber materials that may have one or more flexible properties. This flexibility in the material(s) may enable the base 410 and walking cane 410 to operate in a manner resembling a movement of a human foot, and provide a natural feel and comfort to the user.

According to this specific example, a bend occurs at a connecting point where the base 410 connects to the stem 420. A base 410 may be slightly wider at this connecting point, to accommodate any force exerted on the point. This bend may resemble a bend that a human ankle may have when walking. Additionally, one or more toes may bend to accommodate a force applied as the connecting portion 440 moves, and a center of the base 410 may slightly bend at an arch.

Additionally, when a force is applied to a ball portion of a base such as base 410, one or more toe portions of the base 410 may grip an underlying surface. To further assist the toe portions in gripping an underlying surface, pads made of a material such as rubber may be provided at a bottom surface of one or more of the toes.

According to another embodiment, an inside of a base, such as base 410, may include one or more mechanical features such that when pressure is applied towards a center area of the base, one or more hardware elements may extend into one or more of the toe portions to provide stability in the toe portions. For example, pressure applied towards the center area of the base may cause a reflexive action by the one or more hardware elements to extend outward towards or into one or more toe portions of the base.

Also shown, the base 410 may enable the walking cane 400 to move flexibly, without causing a break between the stem 420 and the base 410. In this way, the walking cane 400 may feel more natural to a user because the walking cane 400 may mimic a manner in which a human foot would likely move.

Figure 5:
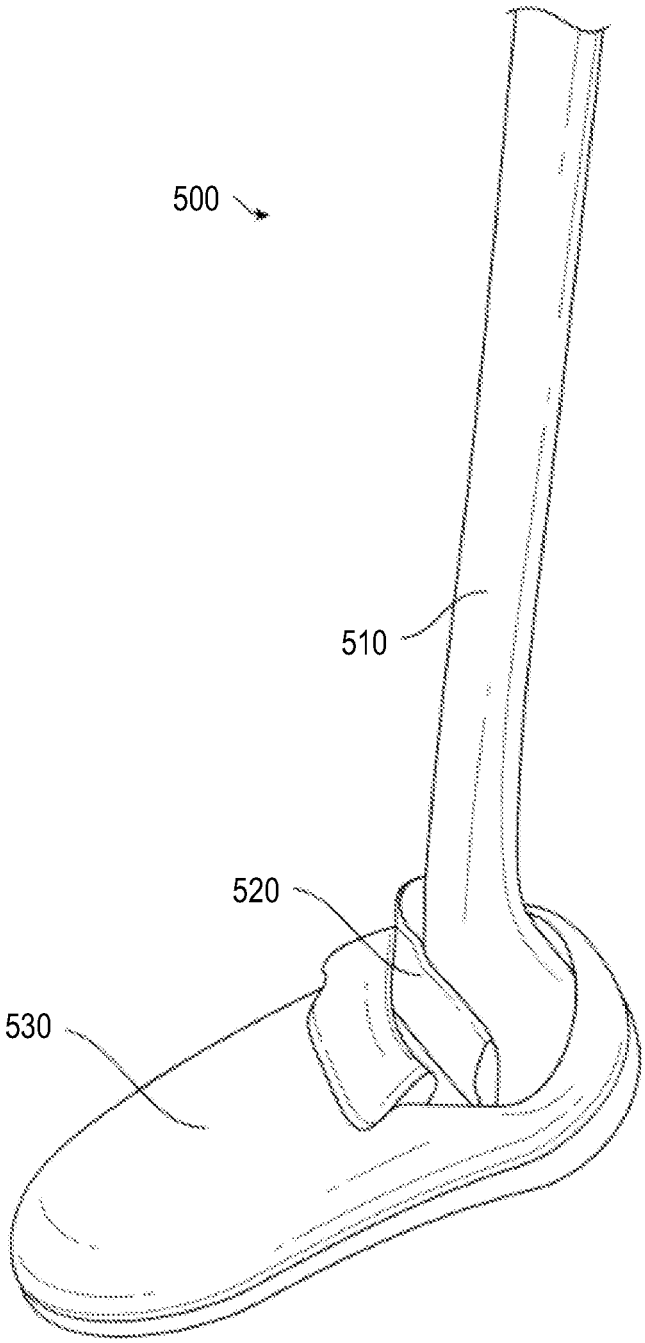
FIG. 5 is a perspective view of an example walking cane with a shoe covering a base, in accordance with an embodiment.

FIG. 5 is a perspective view of an example walking cane 500 with a stem 510 and a base 520 with a shoe covering 530, according to an example embodiment. A covering 530 may alternatively be any other type of covering than what is shown in FIG. 5, such as a boot, a bootie, a flat, a light heel, an athletic shoe, a loafer, a scrub covering, or any other footwear of the like. According to an example embodiment, instead of a covering provided over a base portion, one or more soles may be provided at a bottom of the base portion. Such a sole may be snapped onto the base portion, or otherwise coupled to a bottom of the base portion. The sole may imitate a sole of a boot, heel, athletic shoe, etc., or a sole may be provided in the form of a cleat, hiking shoe, or shoe suitable for use on icy or dirt-covered surfaces. In one or more embodiments, a covering 530 may serve as an ornamental or aesthetic design selected by the user. Moreover, a covering may allow a user to experience the comfort of having a shoe, such as added shock absorption or added stability due to possible gripping properties and supporting elements of the shoe. A covering may also provide a barrier for a base of a cane, to protect the base from being damaged by external forces.

In operation, a covering 530 may be removable such that a user can select different coverings for different occasions. For example, a user may want a durable heel for outdoor walking or a non-marking sole for indoor events. As a result, base 520 may undergo certain cycling during removal or application of the covering 530. Accordingly, the base may be made of any flexible but durable material such as silicone or the like. Providing flexion may simplify installation into the covering 530, for example by allowing the user to bend the base 520 to guide the base 520 into the covering 530. However, durability is also desirable for both situations where the covering 530 is not used and also to prevent damage for repeated changes of covering 530. The base 520 may be inserted into any shoe of choice. The base 520 may be tied or strapped in, similar to how a human foot may be secured to a shoe. The base may alternatively be adhered to the shoe via foam or other adhesive material that secures the base inside the shoe. Alternatively, a stem portion may be directly connected to a filled covering, where a covering may be filled with a material, such as a polymer material, and cured or otherwise coupled to the stem portion.

Figure 6:
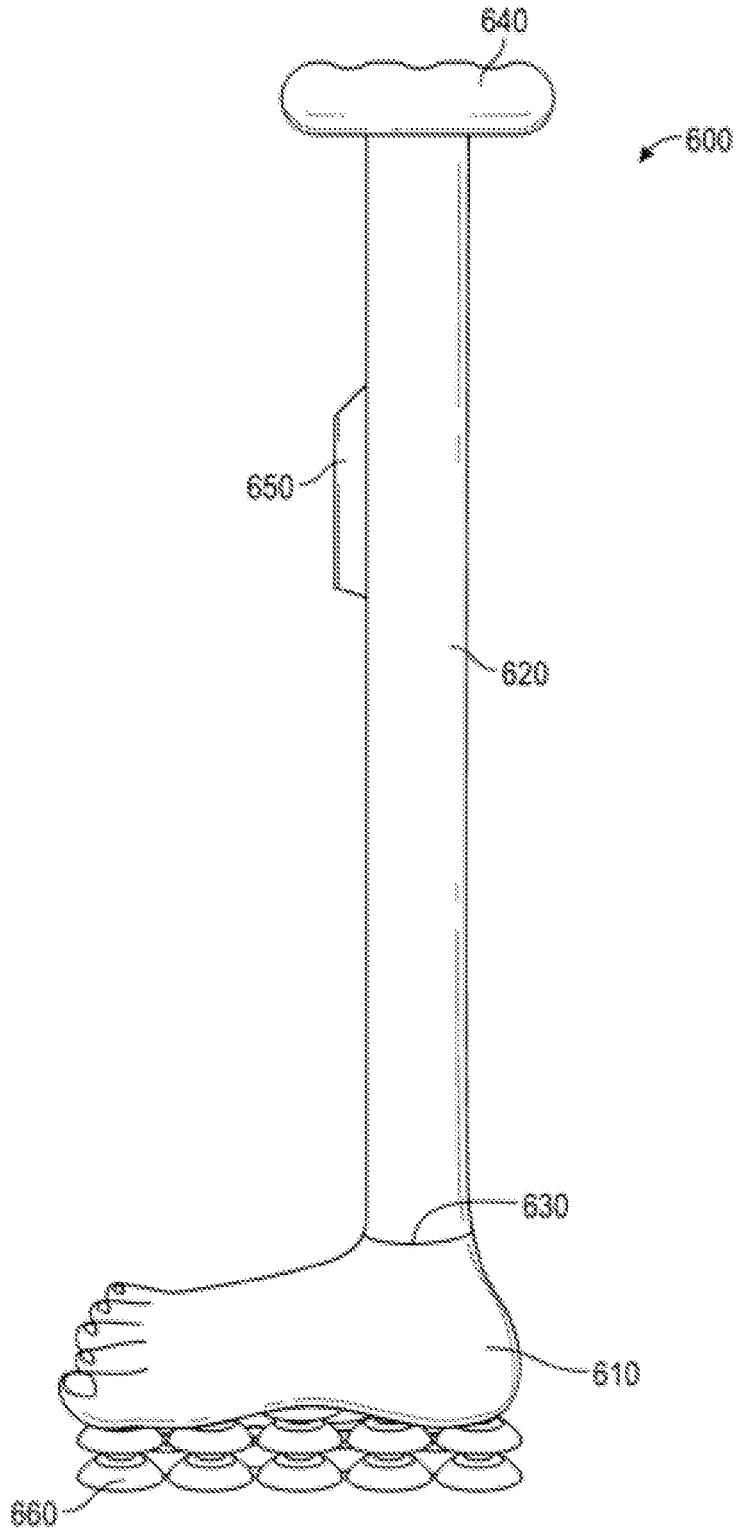
FIG. 6 is a side view of an example base of a walking cane with a grip, in accordance with an embodiment.

FIG. 6 illustrates a cane 600 having a base portion 610, a stem portion 620, a connecting portion 630 that connects the base portion 610 to the stem portion 620, a handle portion 640, and an optional lighting portion 650, according to an example embodiment. At a bottom or underside of the base portion 610, a gripping portion 660 may be provided.

A lighting portion 650 may be motion activated, manually activated by a switch, button, or voice, and/or activated in response to a change in a surrounding environment, as described above. For example, if the surrounding environment is dark, the lighting portion 650 may be automatically activated for ease of user navigation. Additionally, this lighting portion may be provided elsewhere on a cane 600, such as by a base portion 610, other parts of a stem portion 620, or by a handle portion 640.

The gripping portion 660 may be provided using a material such as silicone, rubber, or other substance that naturally grips or sticks to a surface, including a jagged, wet, and/or inclined surface. In another example embodiment, gripping portion 660 may be comprised of suction cups, each suction cup being of a standardized or variable size, for providing added cushioning and security for the user.

Figure 7:
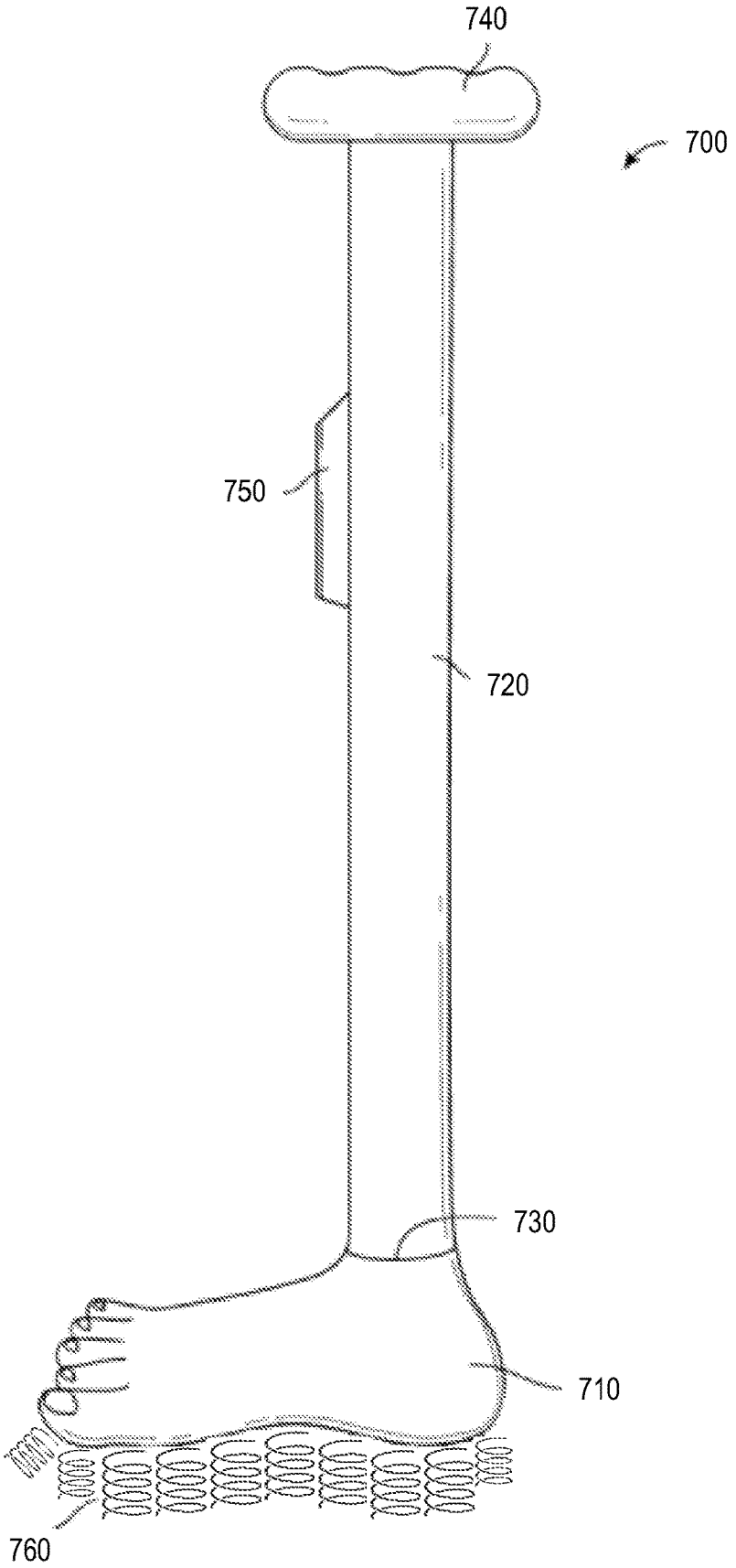
FIG. 7 is a side view of an example base of a walking cane with springs/coils provided under a base, in accordance with an embodiment.

FIG. 7 illustrates a cane 700 having a base portion 710, a stem portion 720, a connecting portion 730 that connects the base portion 710 to the stem portion 720, a handle portion 740, and an optional lighting portion 750, according to an example embodiment. At a bottom or underside of the base portion 710, one or more springs or coils 760 may be provided.

A lighting portion 750 may be motion activated, manually activated by a switch, button, or voice, and/or activated in response to a change in a surrounding environment, as described above. For example, if the surrounding environment is dark, the lighting portion 750 may be automatically activated for ease of user navigation. Additionally, this lighting portion may be provided elsewhere on a cane 700, such as by a base portion 710, other parts of a stem portion 720, or by a handle portion 740.

The springs or coils 760 may be provided using a material such as metal, coated or covered by another material such as silicone, rubber, or other substance that naturally grips or sticks to a surface, including a jagged, wet, and/or inclined surface. In another example embodiment, the one or more springs or coils may be of a standardized or variable size, for providing added cushioning and security for the user. Further, the springs or coils may be provided at a bottom of a base or within a portion of the base, and may provide for a more natural gait when in use. One or more springs or coils may also be provided along a toe portion of a base, or under the toe portion.

Figure 8A:
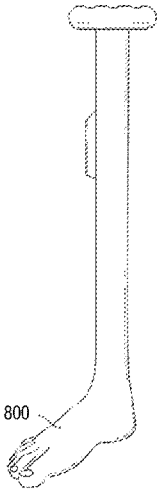
FIGS. 8A-8F are side views of example walking canes having various decorative ornaments on top of the bases of the canes, in accordance with an embodiment.

FIGS. 8A-8F show example canes according to various example embodiments. FIG. 8A shows an example cane without any coverings or ornaments on a base portion 800. Coverings or ornaments may cover an entire portion of a base portion 800 such that base portion 800 is not clearly visible to the naked eye when the covering or ornament is placed on top of the base portion. Alternatively, coverings or ornaments may show at least a portion of an underlying base portion 800.

Figure 8B:
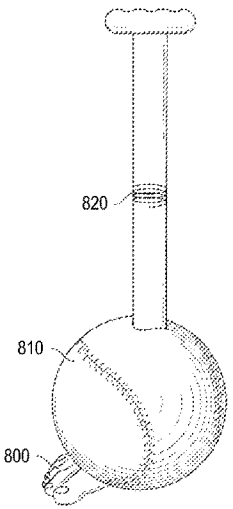

FIG. 8B shows a cane having an example baseball ornament 810 provided on top of a base portion 800. This baseball ornament 810 is provided only as an example, and may be representative of other teams or types of sports. For example, the baseball ornament 810 may be provided as a soccer ball, basketball, softball, or any other type of representation of a sport or team. Moreover, different logos or styles may further be incorporated, such as team names, mascots, university names, or the like.

Also shown in FIG. 8B, a stem may also have a bending portion 820 provided in the middle, approximate to where a knee of a user would naturally fall, to improve comfort. This bending may be supported by a hinge-like connection with adjustable restriction. Alternatively, this bending may be supported by a ball and socket joint, or with a rubber material snaked into a bendable accordion format. For each of these example configurations, the bending portion 820 may restricted such that it does not cause imbalance to the cane or the user. For example, the bending portion 820 may be restricted to adjustable radii depending on a height and/or a weight of the user.

Above or below a bending portion 820, a stem may be adjusted to fit the height of the user. By way of example, a biased pin may be arranged on an internal sliding pole or structure that may be biased outward to extend through a notch formed in an external pole to set a specific height. To adjust the height, a user may overcome the biased pin, for example by pressing on the pin, and then side the internal or external pole to move the pin to a different notch. Alternatively, a stem may be adjusted by twisting one portion of the stem relative to another such that an internal telescoping mechanism may enable the stem to extend or shorten to a desired height.

Figure 8C:
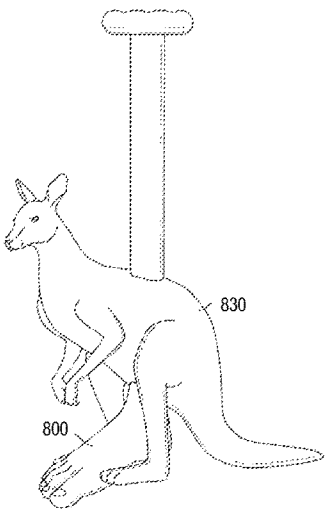
Figure 8D:
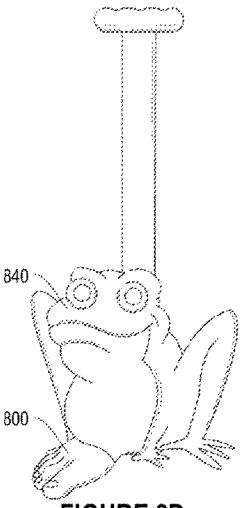

FIGS. 8C and 8D show canes having example animal ornaments 830 and 840 provided on respective base portions 800. These animal ornaments 830 and 840 are provided only as examples, and may be provided as other animals or characters.

Figure 8E:
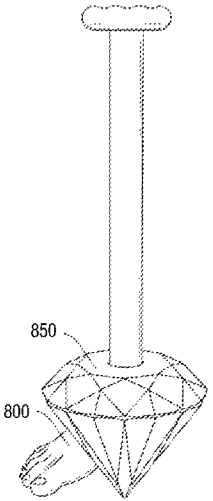

FIG. 8E shows a cane having another example ornament 850, provided in a diamond shape. As explained elsewhere herein, these ornaments are provided only as an example, and are not meant to be limiting. These example ornaments may be provided in any shape or form.

Figure 8F:
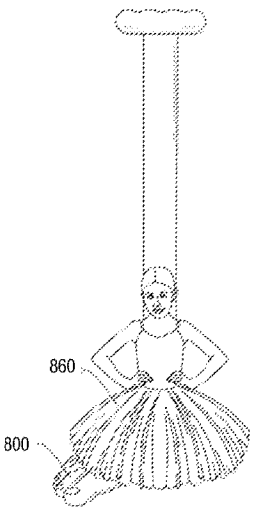

FIG. 8F shows a cane having an example ornament 860 in the form of a ballerina dancer having a decorative tutu provided on top of a base portion 800. This ornament 860 is only provided as an example, and may be in the form of some other kind of character provided on top of base 800 of the cane.

Figure 9A:
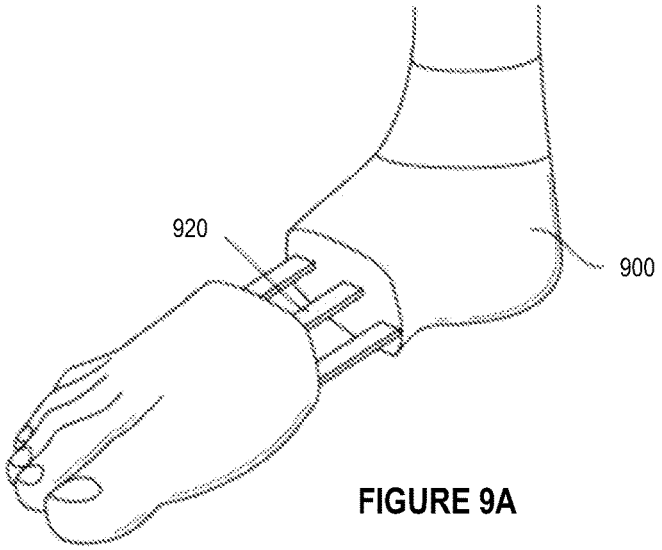
FIGS. 9A-9C are views of an extendible and retractable portion for an example base of a cane, in accordance with an embodiment.
Figure 9B:
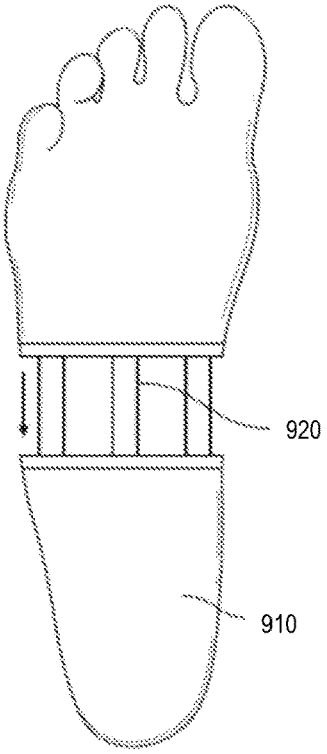

FIGS. 9A-9B show a base portion 900, and a bottom 910 of a base portion 900, of a cane having an extendible or retractable portion 920, according to an example embodiment. This extendible or retractable portion 920 may be provided for a user's adjustment, in order to closely match the size of a base portion 920 to a size of the user's actual foot/feet. This adjustable sizing may provide for additional user comfort and stability, and may enable the cane to feel more natural ergonomically when in use. As an example, the extendible or retractable portion 920 may be arranged in both an axial (e.g., along the length of base portion 900) and lateral (e.g., across the center of the base portion 900) direction, and may enable the adjustment of the width and height of the base portion 900.

The extendible or retractable portion 920 may be provided as a ball portion that fits into a pipe with grooves or some other restriction, for example. Alternatively, the extendible or retractable portion 920 may be provided as a set of tracks having grooves, with one or more clips that can grip the grooves and hold the size in place. Further, the extendible or retractable portion 920 may be provided with telescoping elements such that a base portion 900 may be adjusted with telescoping pipes and some type of restriction such as push buttons or biasing pins. Another example option may be to have a front portion of a base portion be detachable via a tongue and groove connection to the rest of the base portion such that the front portion of the base portion can be interchanged with other sizes. Additionally, another example option may be to have a portion comprising an extension piece tucked within, for example, the base portion. This extension piece may be fixed at a pivot point and may swing out, and an outer area of the extension piece may have push buttons, biasing pins, or grooves to connect to another portion of the base portion, to complete an extended base portion. The extension piece may alternatively be provided at a top and/or bottom area of the base portion. A release button may be provided for ease of retraction. Other types of fittings may be used, so long as they enable the extension and retraction of a base portion 900.

The extendible or retractable portion 920 may ensure that a base portion 900 may be adjusted to match a width, length, and thickness of a human foot, such as the user's foot. In some embodiments, the extendible or retractable portion 920 may be positioned in the middle of a base portion 900 such that a front end and back end of the base portion 900 can be stretched or compressed to a desired height, or such that the right and left sides of the base portion 900 can be expanded or condensed to a desired width. This expansion piece may be useful for users of various heights. For example, the expansion piece may be useful for a child, for example, because the base portion 900 may grow and expand as the child grows up.

Figure 9C:
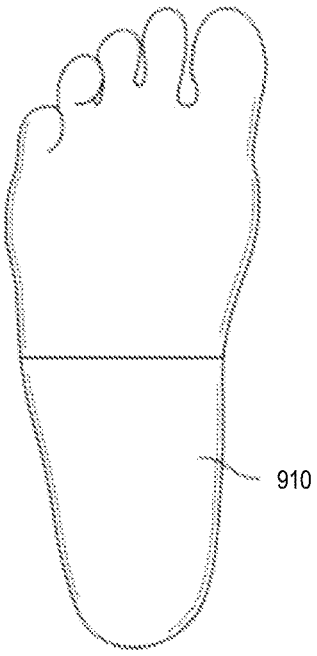

FIG. 9C shows an underside 910 of a base portion having an extendible or retractable portion that is covered, according to an example embodiment. According to an example, an extendible or retractable portion may be covered such that the base portion looks more natural without having externally visible mechanical elements. A seam (not shown) may be provided in the middle of a base portion to cover or partially cover any mechanical elements associated with an extendible or retractable portion. This seam may be provided with a snap button, a hook and loop fastener, a zipper, or any other type of connector to enclose the extendible or retractable portion within a base portion.

FIGS. 10A-10F show various handle options for a cane, according to example embodiments. A handle may be provided at an upper portion of a cane, and may be constructed of various materials including, but not limited to: clay, various types of plastics and resins (of solid or moldable compositions), any type of wood, and durable or pliable metals including aluminum and titanium.

Figure 10A:
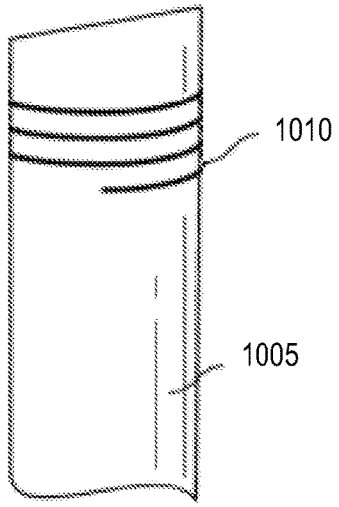
FIGS. 10A-10F are perspective views of example handle-related features for a walking cane, in accordance with an embodiment.

As shown in FIG. 10A, a cane may have various means for changing the heads of the handles, such as using threads 1010 of a stem portion 1005 for an example handle to screw onto. Alternatively, according to an example embodiment, the handles may pop on and off a stem portion of a cane through an interference fit.

Figure 10B:
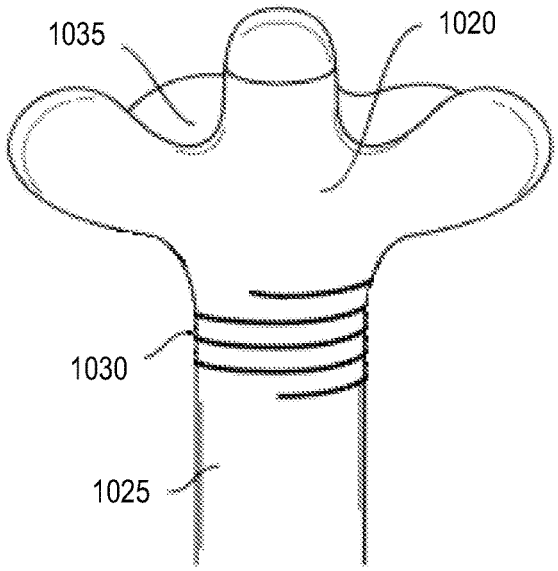

According to the example embodiment provided in FIG. 10B, a handle 1020 may have a faucet knob-like shape split into quadrants, with spaces or grooves 1035 for a user's fingers to fit within the quadrants from above. This handle may additionally include a wider portion at the top-most spoke of the knob near where knuckles of the user's hand may fit, for added stability and comfort. A bottom of the handle 1020 may connect to a stem portion 1025 at a connecting portion 1030, and this connecting portion 1030 may be provided as a threaded portion or a pop-on portion, among other such options.

Figure 10C:
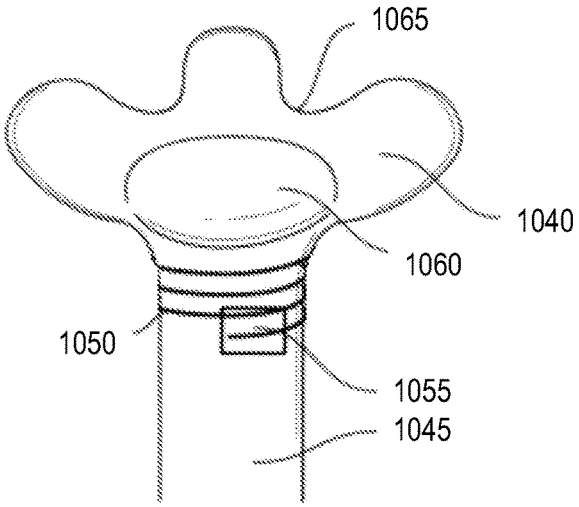

As shown in the example embodiment in FIG. 10C, a handle 1040 may have finger grooves 1065 for individual fingers of a user to fit in at the top, with a bottom surface 1060 for receiving the palm of the user. The bottom surface 1060 may be slightly curved to provide added comfort to a user. The bottom surface 1060 of the handle may connect to a stem portion 1045 at a connecting portion 1050, and this connecting portion 1050 may be provided as a threaded portion or a pop-on portion. According to an example, a bottom surface 1060 may include a pocket or other enclosure to secure a medical chip or GPS chip to help locate and identify information associated with a user. Such a pocket or enclosure may be provided for any type of handle, and is not intended to be limited to the handle of FIG. 10C.

Also shown in FIG. 10C is a button or a chip portion 1055, according to an example embodiment. This button may be pressed to activate an alarm function, where the alarm function may make a loud noise or contact relevant authorities or family members/friends. The alarm may alert bystanders that the user needs help, and may connect to the chip to contact emergency personnel with an accurate location. The button may be provided on top or bottom of the handle, may be covered to prevent accidental pressing, or may be recessed within the handle in a groove big enough to fit a finger.

The alarm function may also be configured to send a notification or connect a phone call to authorities or family members and/or friends. In the notification, a GPS location of a cane may be provided. The alarm function may also be wirelessly connected to one or more client devices which the client can use to provide an input to the client device to trigger a loud noise. This loud noise may be used to assist a user in locating the cane.

A chip portion 1055 may be read by a device such as a chip scanner or processor to provide additional information about the user, such as age, medical history information, medicine information, and emergency contact information in case of an emergency. Contact information may also be stored, in case a cane is misplaced or a user associated with the cane is lost and needs assistance. This information may be read and processed by medical personnel, and the chip could come with some type of computer attachment. The cane may be registered to a database with this associated chip, for locating the owner if the owner is lost.

Additionally, a strap may be coupled to or otherwise connected to a handle such that the strap may be wrapped or otherwise fastened around a user's hand or wrist. According to an example, the strap may be provided as a hook and loop fastener, or may be provided with a buckle or other adjusting means to adjust the strap snug to a user's hand or wrist. All or part of the strap may be comprised of a material such as a cloth, leather, elastic, or silicone material. Further, according to an example, the strap may be provided with one or more decorative ornaments. The strap may be provided at a handle or directly below a handle.

Figure 10D:
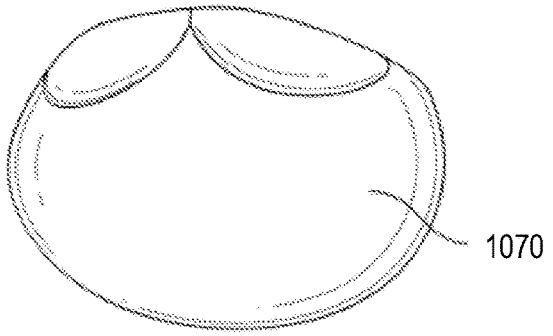
Figure 10E:
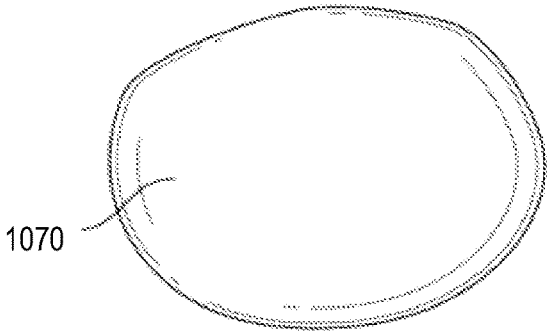
Figure 10F:
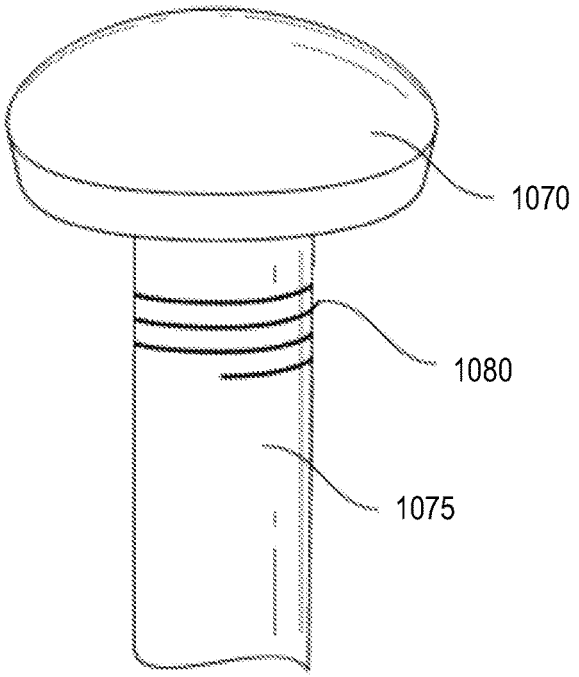

FIGS. 10D-10F show another example handle 1070, according to an example embodiment. FIG. 10D shows an example handle 1070 from an overhead view, and FIG. 10E shows an example handle 1070 from an angled perspective. FIG. 10F provides an example embodiment showing the example handle 1070 connected to a stem portion 1075 via a connecting portion 1080. The example handle 1070 may be flat on a top surface, and may be made of a material such as some type of silicone-based gripping material for comfort and user stability.

Figure 11:
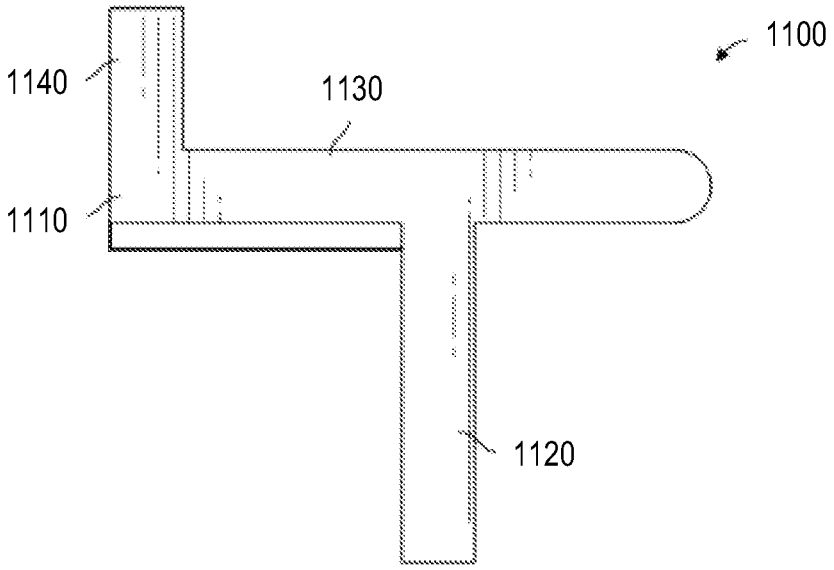
FIG. 11 is a perspective view of an example handle feature for a walking cane, in accordance with an embodiment.

FIG. 11 shows a side view 1100 of an example handle 1110 that may be connected to a stem portion 1120, according to an example embodiment. The example handle 1110 may include a bar-shaped portion 1130 with a protruding portion 1140 extending forward to provide added support between the user's fingers. For example, the bar-shaped portion 1130 may be positioned perpendicular to the protruding portion 1140 at a 90° angle relative to the protruding portion 1140. The bar-shaped portion may be positioned perpendicular to the stem portion 1120. Alternatively, a bar-shaped portion may be provided at an angle that is less than 90° relative to the protruding portion. According to another example embodiment, a bar portion may have grooves at the end for supporting some or all of the fingers.

The handle may additionally or alternatively include a moldable material such as gel or clay to mold to the wearer's hand, for a more custom fit. This gel or clay may provide comfort to the user, especially for prolonged usage.

Figure 12A:
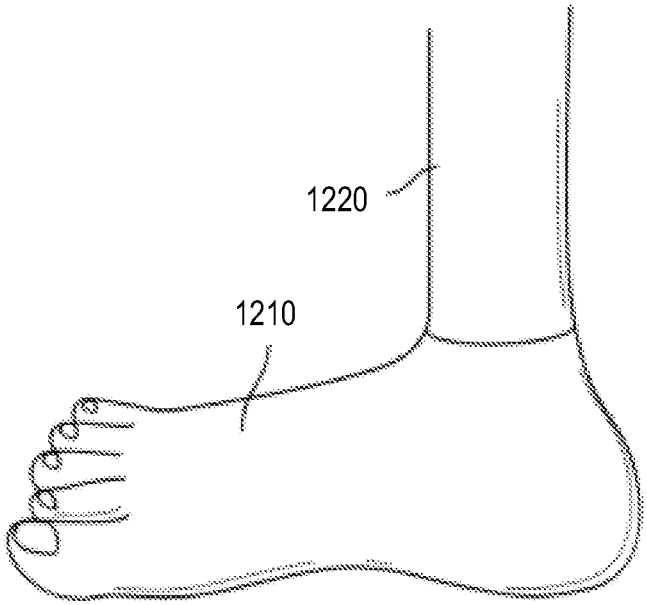
FIGS. 12A and 12B are side views of an example base with and without a covering, in accordance with an embodiment.
Figure 12B:
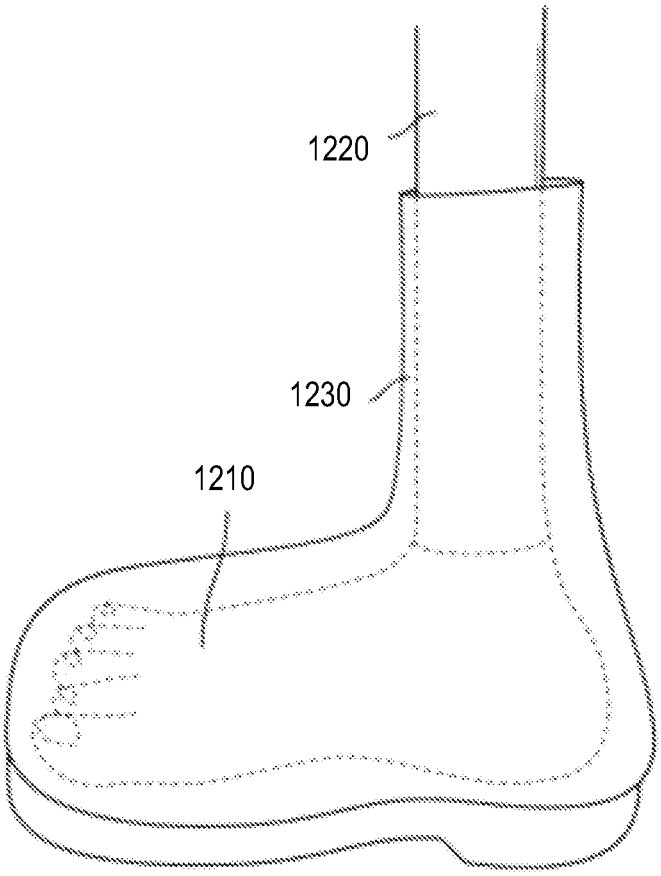

FIG. 12A shows an example configuration of a base portion 1210 connected to a stem portion 1220. FIG. 12B shows an example configuration of a boot-shaped covering 1230 covering the base portion 1210 and the stem portion 1220. This covering 1230 may be put on using a same or similar method as a user would ordinarily put on a boot. Such a covering may provide for comfort in that it may elevate the overall cane to a height that might match a user's natural height if they are wearing similar shoes/boots. Additionally, a covering may provide for additional grip on a slick or uneven pavement. Alternatively, the covering may be filled with a material such as a polymer or other material to fix the covering to a stem portion. According to an example, the stem portion may be fixed to the shoe by screwing in the shoe directly to the stem portion, or by locking the shoe portion in place via other fixing means. The shoe may have one or more slots to provide the fixing means within the filled shoe.

Figure 13:
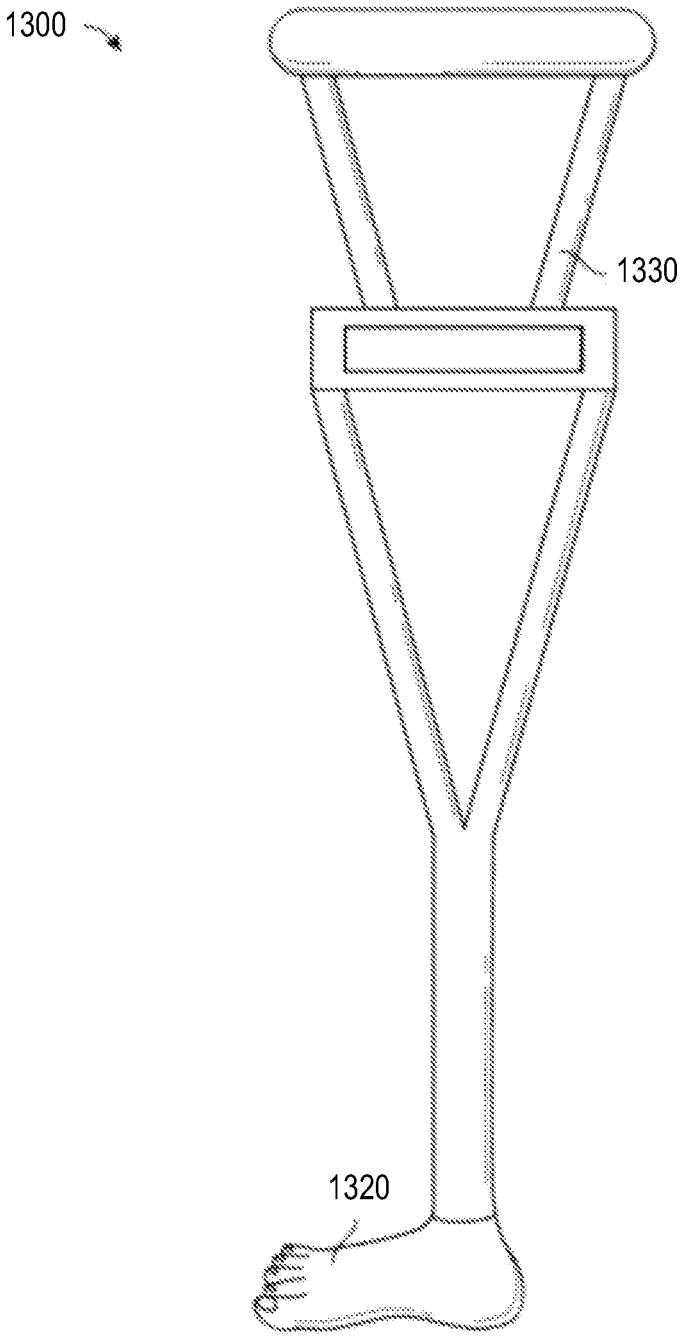
FIG. 13 is a side view of an example detachable base attached to a crutch, in accordance with an embodiment.

FIG. 13 shows an example embodiment including a crutch add-on to an example base. A removable base 1320 as described above with respect to other figures may be added to the bottom of a crutch 1330 for extra support and stability to a user. A base 1320 may alternatively be pre-attached to a crutch 1330 so that it is not easily removable. FIG. 13A shows an example embodiment of a crutch assembly 1300 where a base 1320 is not covered in any way. In contrast, FIGS. 14 and 15 show an example embodiment of a crutch assembly 1430, 1530, where a base 1410, 1510 is covered by covering 1420, 1520.

The crutch assembly is provided merely as an example, and may be substituted with a walking cane stem or a hiking stick stem, for example. Additionally, the crutch, walking cane stem, and hiking stick may be provided as interchangeable options such that a same base portion may be used for each option.

Figure 14:
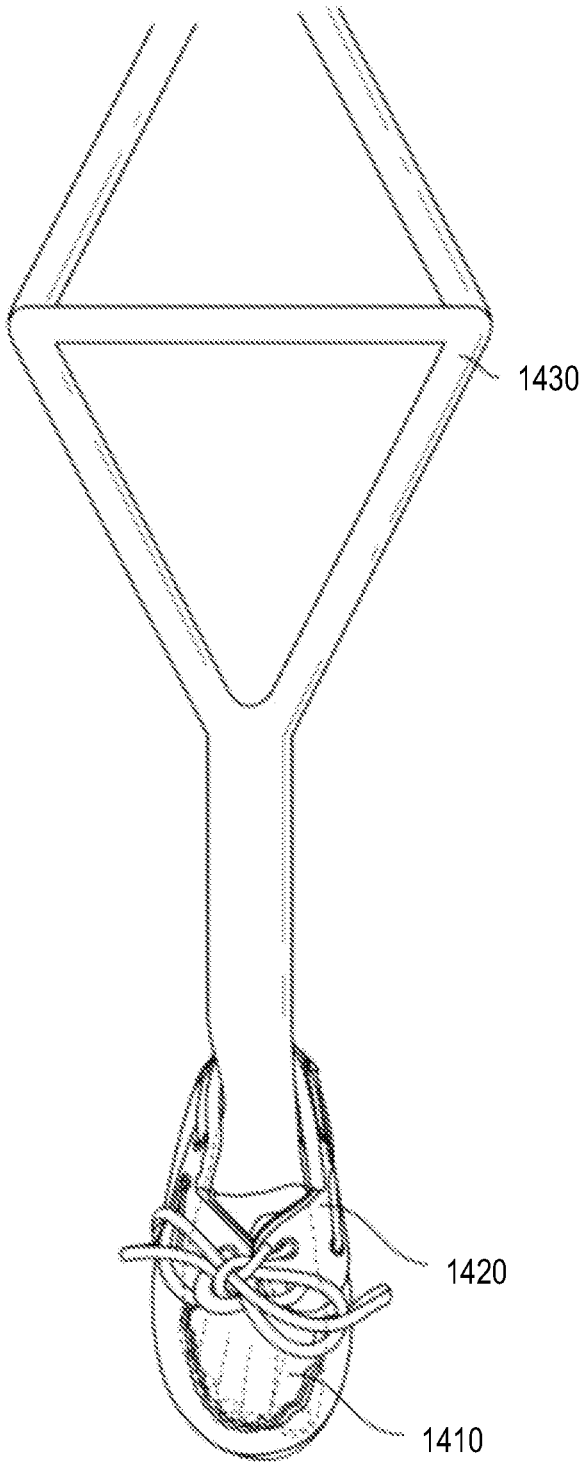
FIG. 14 is a perspective view of an example child-sized covering for a crutch associated with the base, in accordance with an embodiment.

FIG. 14 shows an example embodiment having a base portion 1410 connected to a crutch 1430, where the base portion 1410 has a shoe covering 1420. In this example, the shoe 1440 may be a toddler or small child's shoe, and the base portion 1410 and crutch portion 1430 may be used by a toddler or small child. Additionally, as explained elsewhere herein, a base portion and crutch portion may be adjustable to fit the needs of a user based on the user's height and weight requirements.

Figure 15:
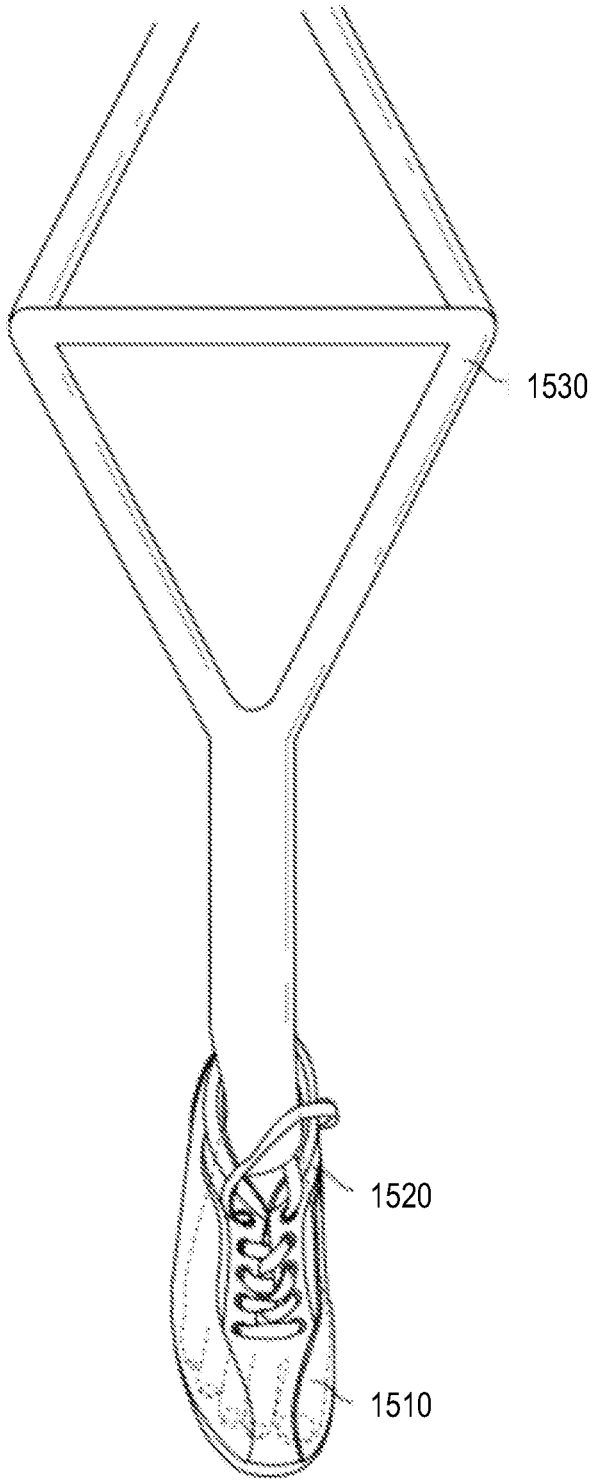
FIG. 15 is a perspective view of an example adult-sized covering for a crutch associated with the base, in accordance with an embodiment.

FIG. 15 shows an example embodiment having a base portion 1510 connected to a crutch 1530, where the base portion 1510 may be provided with a shoe covering 1520. In this example, the shoe 1540 may be a child's, young adult's, or adult's shoe, and the base portion 1510 and crutch portion 1530 may be used by a child, young adult, or adult.

For the examples shown in FIGS. 14 and 15, one or more other coverings may be utilized, as described elsewhere herein.

Although embodiments of this design have been fully described with reference to the accompanying drawings, it is to be noted that various changes and modifications will become apparent to those skilled in the art. Such changes and modifications are to be understood as being included within the scope of embodiments of this design as defined by the appended claims. The invention is to be understood as not limited by the specific embodiments described herein, but only by scope of the appended claims.

What is claimed is:

1. A system comprising:

a crutch member to be received by an arm or a hand of a user; and a base coupled to the crutch member, the base being provided at least in part in a shape of a human foot and including at least a forward portion comprising a set of individual toe portions and a rearward portion, the base being flexible to provide support responsive to a force applied to at least one of: at least one toe portion of the set of individual toe portions or the rearward portion.

2. The system of claim 1, wherein the crutch member is adjustable to be lengthened or shortened to a plurality of heights.

3. The system of claim 1, wherein the base is at least partially made of a silicone or a rubber material.

4. The system of claim 1, wherein the base is removable from the crutch member.

5. The system of claim 1, wherein the base is configured to be at least partially covered by at least one covering.

6. The system of claim 1, wherein the base has an adjustable portion to extend or retract the base to a plurality of sizes.

7. The system of claim 6, wherein the adjustable portion extends or retracts length-wise or width-wise.

8. The system of claim 1, wherein the crutch member has a bending portion, wherein upon activation the bending portion moves relative to a force within a predetermined range.

9. The system of claim 1, wherein the crutch member has a lighting portion activated by at least one of a detected motion of the system or a lighting change of a surrounding environment.

10. The system of claim 1, further comprising an alarm button to activate a noise, to send a notification, or to provide a location of the crutch member.

11. The system of claim 1, wherein one or more springs are provided at a bottom surface of the base or within the base.

12. A device for providing walking assistance comprising:

a crutch member to be received by an arm or a hand of a user; and a base coupled to the crutch member, the base being at least in part in a shape of a human foot and being flexible to provide support responsive to one or more forces applied to at least one of: at least one toe portion of a set of individual toe portions of the base or a rearward portion of the base.

13. The device of claim 12, wherein the crutch member is adjustable to be lengthened or shortened to a plurality of heights.

14. The device of claim 12, wherein the base is at least partially made of a silicone or a rubber material.

15. The device of claim 12, wherein one or more springs are provided at a bottom surface of the base or within the base.

16. The device of claim 12, wherein the base is configured to be at least partially covered by at least one covering.

17. The device of claim 12, wherein the base has an adjustable portion to extend or retract the base to a plurality of sizes.

18. The device of claim 12, wherein the crutch member has a bending portion, wherein upon activation the bending portion moves relative to a force within a predetermined range.

19. The device of claim 12, wherein the crutch member has a lighting portion activated by at least one of a detected motion of the device or a lighting change of a surrounding environment.

20. The device of claim 12, further comprising an alarm button to activate a noise, to send a notification, or to provide a location of the crutch member.

* * * * *